US009771956B2

(12) United States Patent
Asai et al.

(10) Patent No.: US 9,771,956 B2
(45) Date of Patent: Sep. 26, 2017

(54) ACTUATOR, ACTUATOR APPARATUS, AND METHOD OF DRIVING ACTUATOR

(71) Applicant: Panasonic Intellectual Property Management Co., Ltd., Osaka (JP)

(72) Inventors: Katsuhiko Asai, Nara (JP); Takayuki Nagata, Osaka (JP); Kazuo Inoue, Osaka (JP)

(73) Assignee: PANSONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/244,066

(22) Filed: Aug. 23, 2016

(65) Prior Publication Data

US 2017/0067491 A1 Mar. 9, 2017

(30) Foreign Application Priority Data

Sep. 4, 2015 (JP) ..... 2015-175106

(51) Int. Cl.
*F15B 15/10* (2006.01)

(52) U.S. Cl.
CPC ..... *F15B 15/103* (2013.01)

(58) Field of Classification Search
CPC ..... F15B 15/103; F16J 3/00; F16J 3/02; F16J 3/04; F16J 3/041; B25J 9/142; F04B 43/084; F04B 43/086
USPC ..... 92/47, 90, 91, 92, 93; 901/22
See application file for complete search history.

(56) References Cited

U.S. PATENT DOCUMENTS

| | | | | | |
|---|---|---|---|---|---|
| 737,154 | A * | 8/1903 | Sayer | F16F 9/0454 | 267/122 |
| 1,714,988 | A * | 5/1929 | Schlaich | B21C 37/15 | 73/743 |
| 3,331,400 | A * | 7/1967 | Vilkaitis | H01P 3/14 | 138/122 |
| 3,561,330 | A * | 2/1971 | Rich | B25B 5/061 | 294/119.3 |
| 4,792,173 | A * | 12/1988 | Wilson | B25J 9/1075 | 294/119.3 |
| 4,976,191 | A * | 12/1990 | Suzumori | B23Q 1/34 | 92/103 R |
| 5,080,000 | A * | 1/1992 | Bubic | B25J 18/06 | 294/119.3 |

FOREIGN PATENT DOCUMENTS

JP 59-197605 11/1984

* cited by examiner

*Primary Examiner* — Edelmira Bosques
*Assistant Examiner* — Michael Quandt
(74) *Attorney, Agent, or Firm* — Wenderoth, Lind & Ponack, L.L.P.

(57) ABSTRACT

An actuator converts the pressure of a fluid into a change in the length of the actuator and is formed such that an elastic tube is spirally wound. The tube is wound around the axis of the actuator. One or more grooves are spirally formed on the outer surface of the tube along the axial center of the tube. When the fluid contained in the inside of the tube is pressurized, a torsional force is applied to the tube along the spirals of the one or more grooves and causes the actuator to contract in the axial direction. Even when an external force acts in a direction in which the actuator is bent, the volume of the inside of the tube is not substantially varied. Accordingly, the actuator can be allowed to freely move in a bending direction.

9 Claims, 14 Drawing Sheets

ACTUATOR, ACTUATOR APPARATUS, AND METHOD OF DRIVING ACTUATOR

BACKGROUND

1. Technical Field

The present disclosure relates to an actuator, an actuator apparatus, and a method of driving the actuator.

2. Description of the Related Art

There is a growing need for machines that work close to humans such as domestic robots. Accordingly, expectations for artificial muscle actuators, which have characteristics of being light and being flexible such as in the case of muscle of humans, are growing. There are many different types of actuators called artificial muscle actuators. Many of these actuators use deformation of a rubber-like elastic material, which is likely to match the characteristics of being light and being flexible.

A McKibben-type actuator, which extends or contracts due to the pressure of a fluid, is known as one of the actuators that use the deformation of a rubber-like elastic material (see, for example, Japanese Unexamined Patent Application Publication No. 59-197605).

The McKibben-type actuator disclosed in Japanese Unexamined Patent Application Publication No. 59-197605 is formed of a rubber tube reinforced by a braided structure, and is caused to extend and contract in a manner in which the inside of the rubber tube is pressurized by the fluid, and expansion of the actuator in the radial direction is converted into contraction of the actuator in the axial direction while angles of braids are varied like a pantograph.

SUMMARY

However, free movement of the McKibben-type actuator in a bending direction is obstructed when the inside of the rubber tube is pressurized, although the McKibben-type actuator extends or contracts in the axial direction by increasing or decreasing the pressure of the fluid in the inside.

One non-limiting and exemplary embodiment provides an actuator that can extend and contract and allows free movement thereof in a bending direction.

In one general aspect, the techniques disclosed here feature an actuator including a hollow tube. The tube has a space therein which is located along a longitudinal axis of the tube. The tube is folded so as to have a coil shape. The tube has one or more grooves formed on an outer surface of the tube and/or an inner surface of the tube. The one or more grooves extend so as to be twisted along the longitudinal axis of the tube.

It should be noted that general or specific embodiments may be implemented as a system, a method, an integrated circuit, a computer program, a storage medium, or any selective combination thereof.

According to the present disclosure, the actuator can extend and contract and allows free movement thereof in a bending direction.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
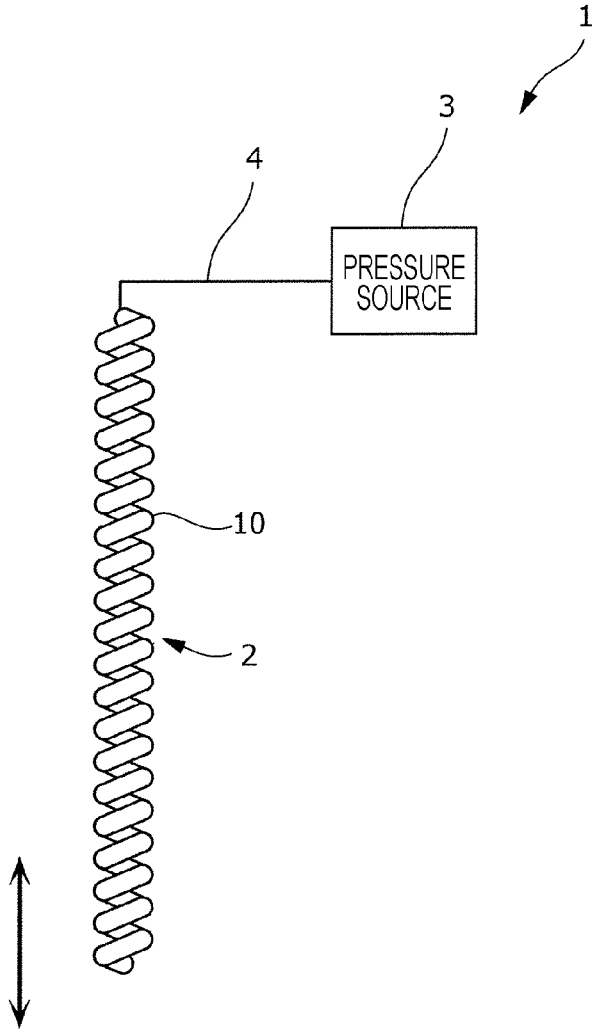
FIG. 1 is a schematic view of an actuator apparatus according to a first embodiment.

Underlying Knowledge Forming Basis of the Present Disclosure

The present inventor uncovered the following problem in the McKibben-type actuator described in the description of the related art.

The McKibben-type actuator is formed of a rubber tube and has inherent flexibility in a bending direction. As the internal pressure of the rubber tube increases, the flexibility decreases and stiffness with respect to bending increases.

Bending stiffness is increased presumably because when the actuator is bent, the volume of an interior space of the rubber tube is varied. In order to bend the actuator, it is necessary to compress a fluid in the interior space and to deform the rubber tube in response to a compressive force of the fluid. As the pressure in the interior space increases, a force required for the bend increases.

Such a property is advantageous in, for example, an action of holding a body by using bending stiffness but causes a problem, for example, when the actuator is installed on assisting wear in the form of clothes. More specifically, in the case where the actuator is installed so as to be bent along the shape of a human body part such as an arm or a leg, a force in an axial direction of the actuator and a force in a direction in which the bend of the actuator along the shape of the human body part is canceled are produced when the fluid is pressurized to cause the actuator to extend or contract. Accordingly, the installed actuator provides assistance with a force in the axial direction but obstructs free movement thereof in a bending direction.

To address such a problem, an actuator according to an aspect of the present disclosure includes a hollow tube. The tube has a space therein which is located along a longitudinal axis of the tube. The tube is folded so as to have a coil shape. The tube has one or more grooves formed on the outer surface of the tube and/or the inner surface of the tube. The one or more grooves extend so as to be twisted along the longitudinal axis of the tube.

With this structure, when a hollow portion of the tube contains a fluid and a pressure thereof is varied, the tube is elastically deformed outward or inward and is twisted along the spirals of the one or more grooves of the tube. The occurrence of the twist enables the actuator having a spirally wound shape to extend and contract. When an external force is applied to the actuator in a direction in which the actuator is bent, a portion whose volume is increased is created in the inside of the tube due to the twist of the tube in a given direction and a portion whose volume is decreased is created in the inside of the tube due to the twist of the tube in the opposite direction. Accordingly, variations in the total volume of the inside of the tube can be made small, and the actuator can be readily bent.

For example, the tube may include a cylindrical first elastic member and a cylindrical second elastic member that is disposed inside or outside the first elastic member and that is more flexible than the first elastic member, and the one or more grooves may be each formed of a through-hole extending from the inner surface of the first elastic member to the outer surface of the first elastic member and a surface of the second elastic member that closes the through-hole.

With this structure, the first elastic member having the through-hole is readily twisted and the tube can accordingly be reliably twisted. This enables the actuator to reliably extend and contract and enables the actuator to be readily bent.

For example, the first elastic member may include one or more spiral bone portions located between the grooves that are adjacent to each other in a circumferential direction of the first elastic member, and the thicknesses of the one or more bone portions may be lower than the widths of the one or more bone portions.

With this structure, when the hollow portion of the tube contains a fluid and a pressure thereof is varied, the first elastic member is readily deformed outward or inward and hence the tube is readily twisted. Accordingly, the actuator readily extends and contracts and is readily bent.

For example, spiral pitches of the one or more grooves may be larger than the length of an outer circumference of the first elastic member.

With this structure, the outward or inward deformation of the first elastic member is readily converted into the twist of the tube and the actuator readily extends and contracts.

For example, the first elastic member may be disposed outside the second elastic member, and ridges formed of the inner surface of the first elastic member and side surfaces of the one or more grooves may be chamfered.

This structure can mitigate stress concentration on the ridges formed of the inner surface of the first elastic member and the side surfaces of the one or more grooves when the first elastic member and the second elastic member are elastically deformed outward or inward. This enables the actuator to smoothly extend and contract and to be smoothly bent. In addition, the durability of the actuator can be improved.

For example, the depths of the one or more grooves may be larger than or equal to half of the thickness of the tube.

With this structure, one or more thick portions of the tube that are located at the bottom of the one or more grooves have decreased thicknesses and are readily deformed, the tube is readily elastically deformed outward or inward, and hence the tube is readily twisted. Accordingly, the actuator readily extends and contracts and is readily bent.

For example, the spiral pitches of the one or more grooves may be larger than the length of an outer circumference of the tube.

With this structure, the outward or inward deformation of the tube is readily converted into the twist of the tube and the actuator readily extends and contracts.

For example, the one or more grooves may be a plurality of grooves.

In the case where the one or more grooves are a plurality of grooves, the spiral pitches of spiral grooves can be increased compared with the case of one groove. This enables the outward or inward deformation of the tube to be readily converted into the twist of the tube and enables the actuator to readily extend and contract.

For example, the widths of the one or more grooves may be constant.

With this structure, a load applied to the tube can be balanced. Accordingly, the actuator can smoothly extend and contract and can be smoothly bent. In addition, the durability of the actuator can be improved.

To address the above problem, an actuator according to another aspect of the present disclosure includes a hollow tube. The tube has a space therein which is located along a longitudinal axis of the tube. The tube is folded so as to have a coil shape. The tube includes a cylindrical first elastic member and a second elastic member that is more flexible than the first elastic member. The first elastic member has a through-hole extending from the inner surface of the first elastic member to the outer surface of the first elastic member. The through-hole extends so as to be twisted along the longitudinal axis of the tube. The second elastic member is disposed in the through-hole.

With this structure, when a hollow portion of the tube contains a fluid and a pressure thereof is varied, the tube is elastically deformed outward or inward and is twisted along the spiral of the through-hole of the first elastic member. The occurrence of the twist enables the actuator having a spirally wound shape to extend and contract. When an external force is applied to the actuator in a direction in which the actuator is bent, a portion whose volume is increased is created in the inside of the tube due to the twist of the tube in a given direction and a portion whose volume is decreased is created in the inside of the tube due to the twist of the tube in the opposite direction. Accordingly, variations in the total volume of the inside of the tube can be made small, and the actuator can be readily bent. In addition, the thickness of the tube can be reduced, and the actuator can be downsized.

An actuator apparatus according to another aspect of the present disclosure includes an actuator, and a pressure source. The actuator includes a hollow tube that is elastic. The tube has a space therein which is located along a longitudinal axis of the tube. The tube is folded so as to have a coil shape. The tube has one or more grooves formed on the outer surface of the tube and/or the inner surface of the tube. The one or more grooves extend so as to be twisted along the longitudinal axis of the tube. The pressure source (a1) causes the actuator to contract by increasing the pressure of the inside of the tube and (a2) causes the actuator to extend by decreasing the pressure of the inside of the tube.

The pressure source may increase a pressure of the actuator by injecting a medium into the inside of the tube in the (a1) and decrease the pressure of the actuator by discharging the medium from the inside of the tube in the (a2).

To address the above problem, a method of driving an actuator according to the present disclosure includes (b1) preparing an actuator. The actuator includes a hollow tube that is elastic. The tube has a space therein which is located along a longitudinal axis of the tube. The tube is folded so as to have a coil shape. The tube has one or more grooves formed on the outer surface of the tube and/or the inner surface of the tube. The one or more grooves extend so as to be twisted along the longitudinal axis of the tube. The method includes (b2) causing the actuator to contract by increasing a pressure of a medium inside the tube.

With this feature, the actuator can reliably contract.

Moreover, (b3) the actuator may be caused to extend by decreasing the pressure of the medium inside the tube.

With this feature, the actuator can reliably extend.

To address the above problem, an actuator apparatus according to another aspect of the present disclosure includes a tube that is elastic and spirally wound and that has one or more grooves spirally formed on the outer surface of the tube and/or the inner surface of the tube. The central axes of the spirals of the one or more grooves are identical to a longitudinal axis of the tube. The inside of the tube contains a fluid. The actuator apparatus includes a pressure source that increases or decreases a pressure caused by the fluid, thereby increasing or decreasing a longitudinal length of the tube.

With this structure, the actuator can be readily bent by an external force while being caused to extend and contract.

It should be noted that general or specific aspects may be implemented as a system, a method, or any selective combination thereof.

The embodiments will be described below with reference to the drawings.

The embodiments described below are general or specific embodiments. Numerical values, shapes, materials, components, the arrangement and connection configuration of the components, steps, the order of the steps, and so on described in the following embodiments are examples and do not limit the present disclosure. Among the components in the following embodiments, components that are not recited in any one of independent claims showing the most generic concept are described as arbitrary components.

First Embodiment

The whole structure of an actuator apparatus 1 will be first described with reference to FIG. 1. The actuator apparatus 1 illustrated in FIG. 1 includes an actuator 2, a pressure source 3, and a pipe 4. The actuator apparatus 1 converts the pressure of the pressure source 3 into a change in the length of the actuator 2.

The actuator 2 includes a hollow tube 10. The tube 10 has a space therein which is formed in the longitudinal direction of the tube 10. The tube 10 is spirally wound. In other words, the tube 10 is folded so as to have a coil shape. An example of the coil shape is a cylindrical shape. The inside of the tube 10 contains a medium. An example of the medium is a fluid, which includes liquid and gas. An example of the liquid is water. An example of the gas is air. An upper part of the actuator 2 is secured to a fixture not illustrated. The upper end of the actuator 2 is connected to the pipe 4. The lower end of the actuator 2 is sealed by, for example, caulking. The structure of the actuator 2 will be described later in detail.

The pressure source 3 increases or decreases the pressure of the inside of the tube 10 of the actuator 2 by increasing or decreasing a fluid inside the tube 10 of the actuator 2 via the pipe 4, thereby causing the actuator 2 to extend or contract.

An example of the pressure source 3 is a pump. Specific examples of the pump include a syringe pump (reciprocating pump). An exemplary syringe pump includes a cylindrical syringe, a movable plunger, and a controller that controls the position of the plunger. The syringe and the plunger act like an injector. The inside of the syringe is pressurized by the plunger and the fluid is delivered from the interior space of the syringe. The inside of the syringe is depressurized by the plunger and the fluid is collected. The syringe pump is operated to adjust (change) the amount of the fluid contained in the inside of the tube 10 of the actuator 2 so that the pressure of the inside of the tube 10 can be adjusted.

The phrase "to adjust (change) the amount of the fluid contained in the inside of the tube 10" may be understood to be "to adjust (change) the density per unit volume of the fluid contained in the inside of the tube 10". "To increase the pressure of the fluid" may be "to increase the amount per unit volume of the fluid". "To decrease the pressure of the fluid" may be "to decrease the amount per unit volume of the fluid".

The pipe 4 is a tubular member that connects the pressure source 3 to the actuator 2 and is a channel through which the fluid flows into and out. In the case where the actuator 2 is directly connected to the pressure source 3, the actuator apparatus 1 may not include the pipe 4. The pipe 4 with a branch pipe may connect the pressure source 3 to a plurality of the actuators 2.

The actuator 2 according to the embodiment will now be described.

Figure 2:
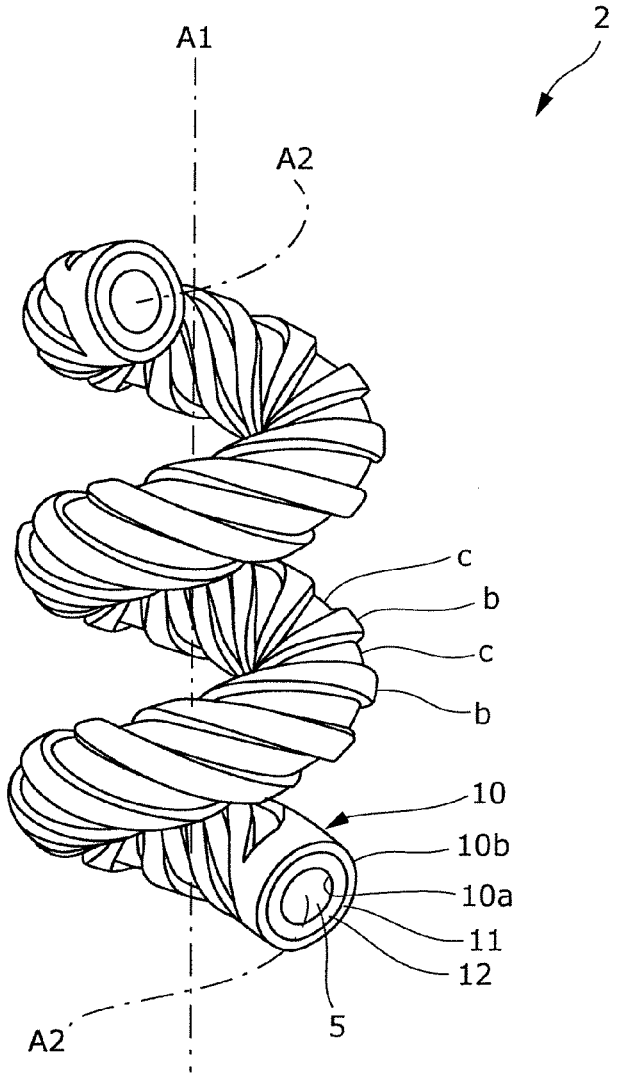
FIG. 2 is a partial view of a tube of an actuator according to the first embodiment.
Figure 3:
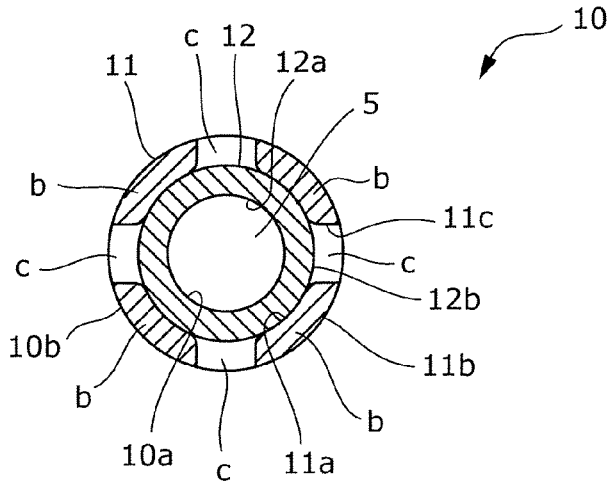
FIG. 3 is a cross-sectional view of the tube of the actuator according to the first embodiment.

FIG. 2 is a partial view of the tube 10 of the actuator 2. FIG. 3 is a cross-sectional view of the tube 10 of the actuator 2.

The actuator 2 is formed such that the hollow tube 10 that is elastic is spirally wound. The tube 10 is wound around the longitudinal axis A1 of the actuator 2. Grooves c are spirally formed on the outer surface 10*b* of the tube 10 such that the central axes of the grooves are the axial center A2 of the tube 10. In other words, the grooves c extend so as to be twisted along the circumference of the longitudinal axis of the tube 10. In the embodiment, the tube 10 is spirally wound clockwise with respect to the axis A1, and the grooves c are spirally wound clockwise with respect to the axial center A2. That is, the direction in which the tube 10 is spirally wound is matched to the direction in which the grooves c are spirally wound.

As illustrated in FIG. 3, the tube 10 includes a cylindrical first elastic member 11, and a cylindrical (tubular) second elastic member 12 that is more flexible than the first elastic member 11. The second elastic member 12 is hollow. A hollow portion of the second elastic member 12 (inside an inner surface 12*a*) contains a fluid 5.

The first elastic member 11 has through-holes 11*c* extending from the inner surface 11*a* of the first elastic member 11 to the outer surface 11*b* of the first elastic member 11. The second elastic member 12 is disposed inside the first elastic member 11 so as to be in contact with the first elastic member 11 and closes the through-holes 11*c*. Accordingly, the grooves c are formed of side surfaces of the through-holes 11*c* of the first elastic member 11 and a surface (outer surface 12*b*) of the second elastic member 12. It is to be noted that the first elastic member 11 and the second elastic member 12 do not adhere to each other.

The first elastic member 11 includes bone portions b located between the grooves c that are adjacent to each other in the circumferential direction of the first elastic member 11. The bone portions b each have an arc shape in section and are disposed so as to be spaced apart from each other in the circumferential direction. The bone portions b are four bone portions b and are spirally wound around the axial center A2 so that four grooves c are spirally formed.

The first elastic member 11 is disposed outside the second elastic member 12. Ridges formed of the inner surface 11*a* of the first elastic member 11 and the side surfaces of the grooves c (through-holes 11*c*) are chamfered. Although the ridges are formed so as to be rounded in the embodiment, the ridges may be tapered.

A member that is more flexible than the first elastic member 11 is used as the second elastic member 12 as described above. Examples of the member that is flexible include a soft member as a material, a structurally soft member such as a deformable member that is formed, for example, so as to be thin or so as to be corrugated.

In the embodiment, nylon is used as the material of the first elastic member 11, and silicon rubber is used as the material of the second elastic member 12. The materials, however, are not limited to these materials, and various resin materials or metallic materials may be used. The first and second elastic members 11 and 12 are appropriately selected in consideration of required pressure resistance, flexibility, or resistance against the fluid 5 (chemical resistance, solvent resistance, and oil resistance), and so on. For example, the use of a resin material for the first and second elastic members 11 and 12 enables the actuator 2 to be lightweight. The use of an engineering plastic material or a metallic material, which has high stiffness, enables the actuator 2 to be operated at a high pressure and a low flow rate and enables a loss due to the flow of the fluid 5 to be reduced.

The pipe 4 of the actuator apparatus 1 has a pressure resistance higher than the pressure resistance of the first and second elastic members 11 and 12 for the purpose of an improvement in responsiveness in operation of the actuator 2.

Figure 4:
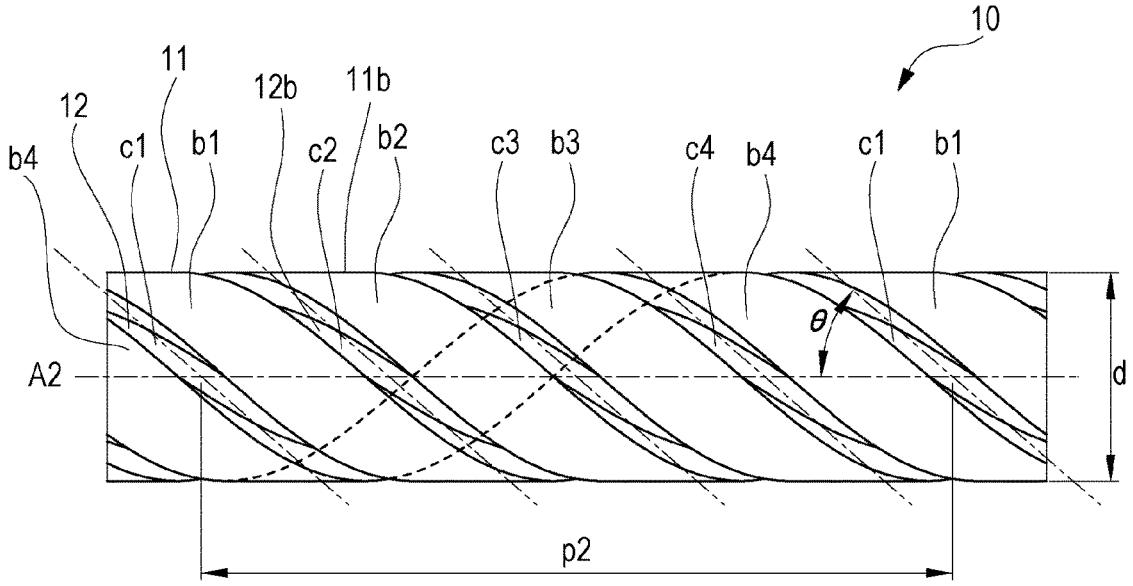
FIG. 4 is a front view of the tube of the actuator according to the first embodiment when the tube is straightened.
Figure 5:
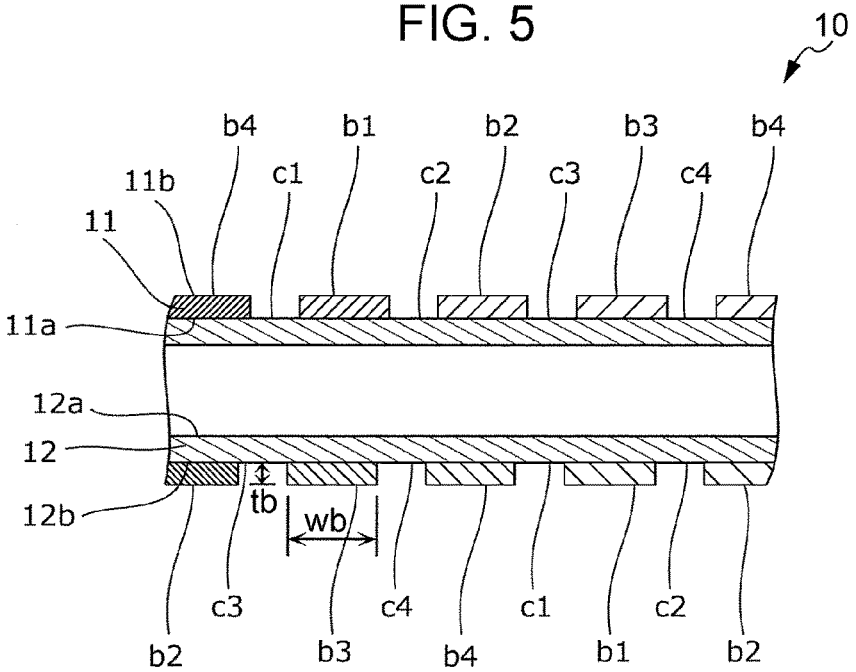
FIG. 5 is a longitudinal sectional view of the tube illustrated in FIG. 4.

FIG. 4 is a view of the tube 10 of the actuator 2 when the tube 10 is straightened. FIG. 5 is a longitudinal sectional view of the tube 10 illustrated in FIG. 4.

As illustrated in FIG. 4 and FIG. 5, the tube 10 has a multi-groove structure, specifically, the four grooves c (c1, c2, c3, and c4) and the four bone portions b (b1, b2, b3, and b4). The grooves c1, c2, c3, and c4 are parallel to one another and have constant widths. The distance between the adjacent grooves c (for example, the distance between the groove c1 and the groove c2) is appropriately designed in accordance with the number of the grooves c. The bone portions b1, b2, b3, and b4 are parallel to one another and have constant widths wb. The thicknesses tb of the bone portions b are smaller than the widths wb of the bone portions b.

The grooves c are formed such that inclinations θ with respect to the axial center A2 of the tube 10 are less than 45° when a pressure applied by the fluid is equal to 0. The diameter d of the tube 10 is 4 mm. The spiral pitches p2 of the grooves c are 14.4 mm. The spiral pitches p2 of the grooves c are set to be larger than the length πd of the outer circumference of the tube 10 (length of the outer circumference of the first elastic member 11 in the embodiment) in a manner in which the inclinations θ of the grooves c are set to be less than 45°.

An outline of a method of driving the actuator 2 will be next described.

Figure 6:
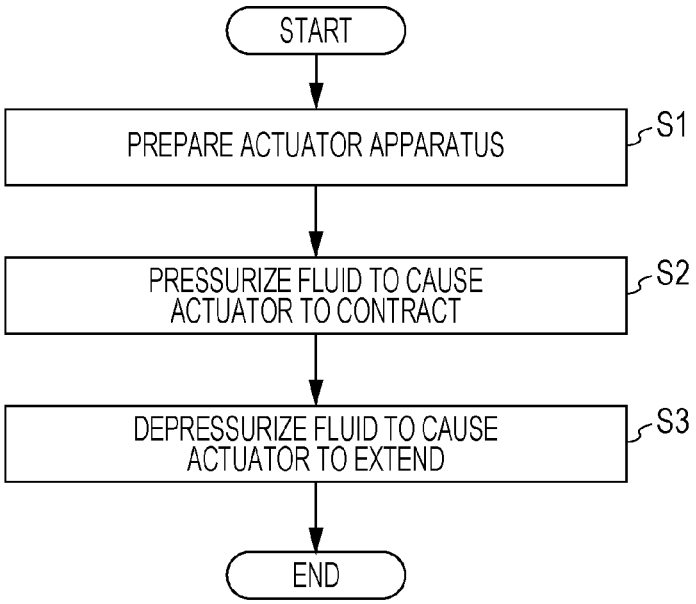
FIG. 6 is a flow chart illustrating a method of driving the actuator.
Figure 8A:
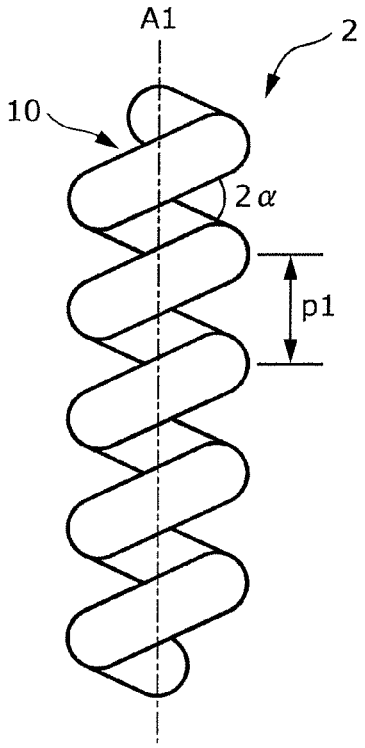
FIG. 8A is a schematic view of the actuator before the fluid inside the tube is pressurized.
Figure 8B:
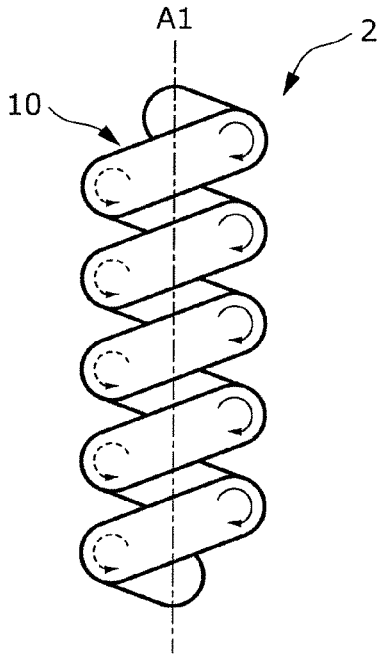
FIG. 8B is a schematic view of the actuator illustrating extension and contraction of the actuator after the fluid inside the tube is pressurized.

FIG. 6 is a flow chart illustrating a method of driving the actuator 2. FIG. 8A and FIG. 8B are schematic views of the actuator 2 illustrating extension and contraction of the actuator 2. In FIG. 8A and FIG. 8B, illustration of the grooves c is omitted.

The method of driving the actuator includes a step (a) of preparing the actuator apparatus 1, and a step (b) of increasing and/or decreasing the length of the actuator 2 in the longitudinal direction (direction of the axis A1).

After the actuator apparatus 1 is prepared and before the fluid 5 inside the tube 10 is pressurized, as illustrated in FIG. 8A, the actuator 2 is in a steady state (S1 in FIG. 6). The steady state is a state in which the fluid 5 inside the tube 10 has been pre-pressurized. In the steady state, the length of the actuator 2 is obtained by adding a contraction due to the pre-pressurization and a deformation due to an external force to a natural length of the actuator 2.

In a state illustrated in FIG. 8A, the fluid 5 is pressurized at, for example, 0.5 MPa by using the pressure source 3, and the fluid 5 is additionally supplied to the inside of the tube 10 of the actuator 2. As illustrated in FIG. 8B, this causes the actuator 2 to contract in the direction of the axis A1 (S2 in FIG. 6). For example, the actuator 2 is caused to contract by injecting the fluid 5 into the inside of the tube 10 by using the pressure source 3.

The actuator 2 is caused to extend in the direction of the axis A1 by depressurizing the fluid 5 by using the pressure source 3 so that the length of the actuator 2 is returned to the original length (S3 in FIG. 6). For example, the actuator 2 is caused to extend by discharging the fluid 5 from the inside of the tube 10 by using the pressure source 3. These steps are repeated to decrease the length of the actuator 2 and subsequently to increase the length of the actuator 2 (to cause the actuator 2 to contract and subsequently to extend). Only one of extension and contraction may be performed, and the order of extension and contraction may be reversed. Only one of extension and contraction may be repeated multiple times.

A mechanism of driving the actuator 2 will be next described.

Figure 7A:
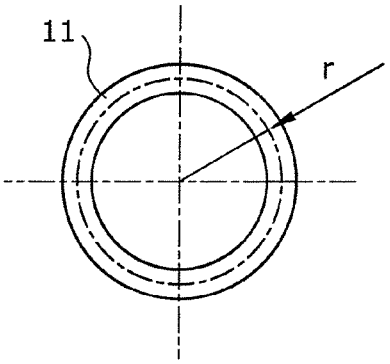
FIG. 7A is a sectional view of a bone portion of a first elastic member before a fluid inside the tube is pressurized.
Figure 7B:
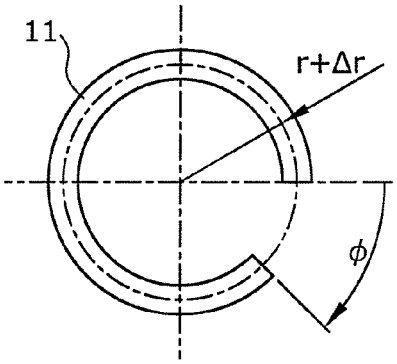
FIG. 7B is a sectional view of the bone portion of the first elastic member illustrating deformation of the bone portion after the fluid inside the tube is pressurized.

FIG. 7A is a sectional view of one of the bone portions b of the first elastic member 11 before the fluid 5 inside the tube 10 is pressurized. FIG. 7B is a sectional view of the bone portion b of the first elastic member 11 illustrating deformation of the bone portion b after the fluid 5 inside the tube 10 is pressurized.

FIG. 7A and FIG. 7B both illustrate a winding of the bone portion b from the direction of the axial center A2.

As illustrated in FIG. 7A, the radius of the bone portion b is r before the fluid 5 is pressurized. When the fluid 5 is pressurized, the first elastic member 11 of the tube 10 is expanded (deformed) in the radial direction due to a pressure applied via the second elastic member 12 of the tube 10, and, as illustrated in FIG. 7B, the radius of the bone portion b accordingly becomes r+Δr. At this time, the bone portion b is twisted at an angle of $\phi=2\pi\Delta r/(r+\Delta r)$ per a winding. The twist causes the entire tube 10 mainly including the first elastic member 11 to be twisted about the axial center A2.

In the embodiment, the grooves c of the tube 10 are wound around the axial center A2 clockwise, and the actuator 2 is wound around the axis A1 clockwise. Accordingly, as illustrated in FIG. 8B, the twist of the tube 10 acts so as to cause the actuator 2 to contract in the direction of the axis A1.

That is, the entire tube 10 is twisted counterclockwise about the axial center A2 with the expansion due to the pressurization and the actuator 2 is wound around the axis A1 clockwise. Accordingly, the tube 10 is twisted counterclockwise such that portions located out of the page toward the reader are rotated in the direction of solid arrows when attention is paid to the right side of the actuator 2 in FIG. 8B. The tube 10 is twisted counterclockwise such that portions located into the page away from the reader are rotated in the direction of dashed arrows when attention is paid to the left side of the actuator 2. Accordingly, the twist occurring over the entire length of the tube 10 acts such that a pitch angle a of the tube 10 is decreased (spiral pitch p1 of the tube 10 is decreased) so that the length of the actuator 2 is decreased.

When the pressurization of the fluid 5 is stopped, the tube 10 deformed in the radial direction and twisted is returned to the original state and the length of the actuator 2 is also returned to the original length due to elastic forces of the first elastic member 11 and the second elastic member 12.

When the tube 10 of the actuator 2 is expanded (deformed), the tube 10 tries to expand (deform) also in the radial direction and the direction of the axis A2, and the grooves c located on the outer circumferential side of the tube 10 try to expand in the width direction of the grooves c. However, when the inclinations θ of the grooves c are less than 45° (spiral pitches p2 are larger than the length πd of the outer circumference of tube 10) as in the embodiment, the tube 10 is sufficiently twisted even when the grooves c are expanded in the width direction. Accordingly, the actuator 2 can sufficiently contract.

A case where the actuator 2 is deformed so as to be bent by applying an external force to the actuator 2 will be next described. The actuator 2 according to the embodiment is also featured such that, when an external force is applied to the actuator 2 in the lateral direction, the actuator 2 is deformed so as to be bent due to the elasticity of the actuator 2 itself without being affected by the pressure of the fluid 5.

Figure 9A:
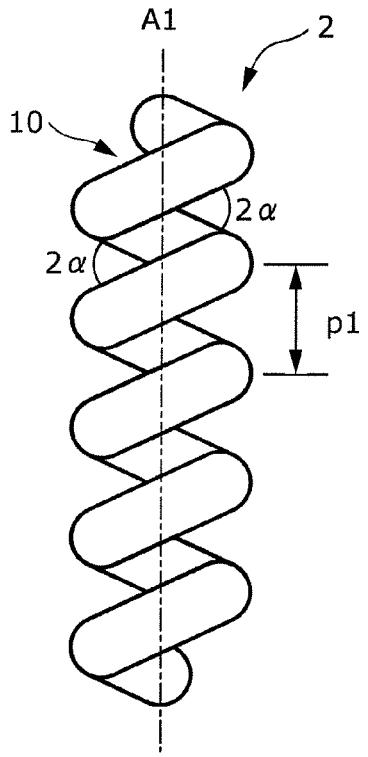
FIG. 9A is a schematic view of the actuator before an external force is applied to the actuator.
Figure 9B:
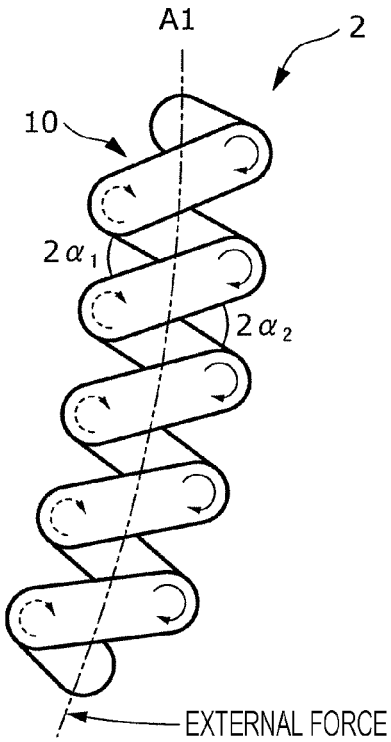
FIG. 9B is a schematic view of the actuator illustrating a state in which the actuator is bent after an external force is applied to the actuator.

FIG. 9A is a schematic view of the actuator 2 before an external force is applied to the actuator 2. FIG. 9B is a schematic view of the actuator 2 illustrating a state in which the actuator 2 is bent after an external force is applied to the actuator 2. In FIG. 9A and FIG. 9B, illustration of the grooves c is omitted.

As illustrated in FIG. 9B, a pitch angle $\alpha_1$ of the tube 10 is decreased and a pitch angle $\alpha_2$ of the tube 10 is increased on the assumption that an external force is applied to the actuator 2 in the vertical direction with respect to the axis A1 of the actuator 2 to bend and deform the actuator 2. Thus, portions on the right side of the tube 10 are twisted counterclockwise such that the portions located out of the page toward the reader are rotated in the direction of solid arrows, and portions on the left side of the tube 10 are twisted clockwise such that the portions located into the page away from the reader are rotated in the direction of dashed arrows.

When the twist occurs in the direction opposite the direction in which the grooves c are spirally wound, the diameter of the tube 10 is increased, and the volume of the inside of the tube 10 is increased. In contrast, when the twist occurs in the direction in which the grooves c are spirally wound, the diameter of the tube 10 is decreased, and the volume of the inside of the tube 10 is decreased. In the embodiment, the volume of the inside of the tube 10 is increased and decreased at the same time. Accordingly, the variations in the total volume of the inside of the tube 10 can be made small and the actuator 2 can be readily bent.

In other words, stiffness when the actuator 2 is bent and deformed does not substantially depend on the pressure acting on the fluid 5 and the stiffness of the actuator 2 itself is dominant. Accordingly, the use of a soft material for the actuator 2 enables the actuator 2 to be readily bent and deformed.

A method of manufacturing the actuator 2 will be next described.

Figure 10:
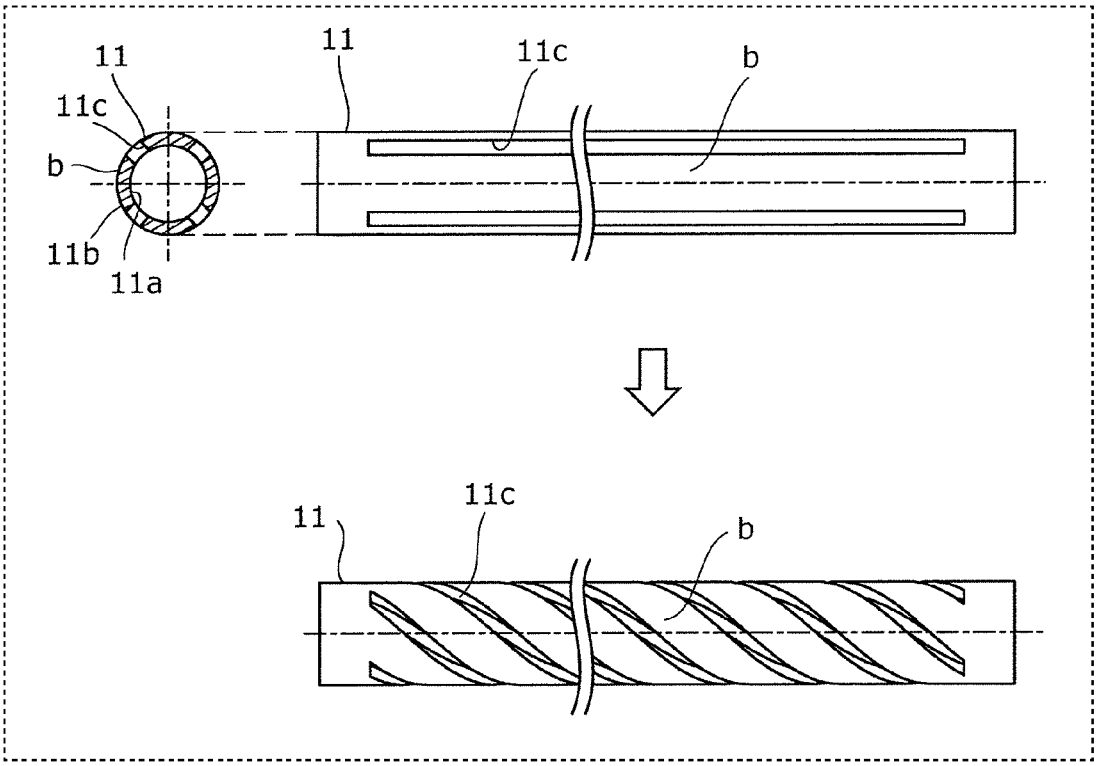
FIG. 10 is a diagram illustrating a method of manufacturing the first elastic member of the actuator according to the first embodiment.

As illustrated in FIG. 10, a cylindrical member that is made of a thermoplastic resin and that includes bone portions b is first prepared. The cylindrical member is heated to a glass-transition temperature or more. In this state, the cylindrical member is twisted and rotated about the axis. The cylindrical member is then cooled to form the first elastic member 11 including spiral bone portions b. The cylindrical second elastic member 12 is next inserted into the inside of the cylindrical first elastic member 11 to form the tube 10 being straightened. The tube 10 is again heated to the glass-transition temperature or more. In this state, the tube 10 is wound around a core material (not illustrated). The tube 10 is then cooled and the core material is extracted. In this way, the actuator 2 that is spirally wound can be manufactured.

The first elastic member 11 can be manufactured by another manufacturing method. For example, the bone portions b made of a thermoplastic resin are spirally wound around a mandrel, which is the core material, and an anneal process is performed. The mandrel is then removed to form the first elastic member 11. Other than these methods, the first elastic member 11 may be manufactured by a three-dimensional modeling method.

Modifications to the actuator 2 according to the first embodiment will now be described.

Figure 11:
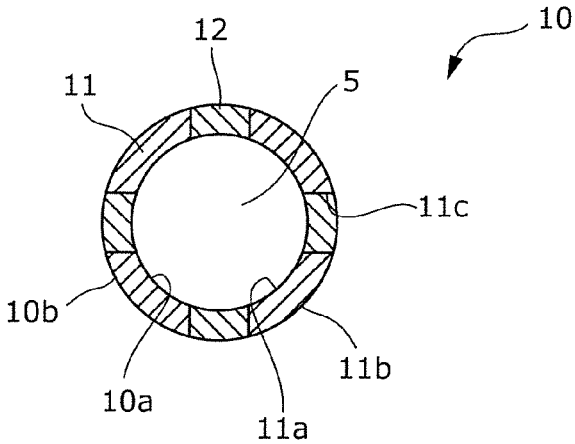
FIG. 11 is a cross-sectional view of a tube of an actuator according to a first modification to the first embodiment.

As illustrated in a first modification in FIG. 11, in the tube 10 of the actuator 2, the second elastic members 12 may be formed such that the through-holes 11*c* of the first elastic member 11 are filled with the second elastic members 12. In other words, the second elastic members 12 may be disposed in the through-holes 11*c* extending from the inner surface 11*a* of the first elastic member 11 to the outer surface 11*b*. The thicknesses of the second elastic members 12 are equal to the thickness of the first elastic member 11. There is no step between the outer surfaces of the second elastic members 12 and the outer surface 11*b* of the first elastic member 11. With this structure, the tube 10 can be formed to be thin and the actuator 2 can be downsized. The thicknesses of the second elastic members 12 are not necessarily equal to the thickness of the first elastic member 11, and there may be a difference between the thicknesses.

Figure 12:
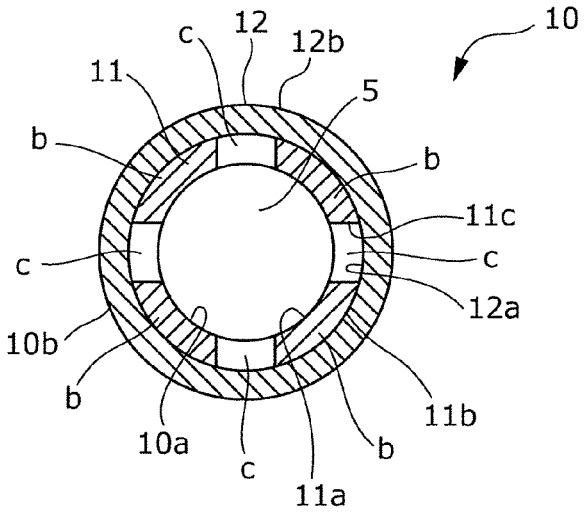
FIG. 12 is a cross-sectional view of a tube of an actuator according to a second modification to the first embodiment.

As illustrated in a second modification in FIG. 12, in the tube 10 of the actuator 2, the second elastic member 12 is joined to the outside of the first elastic member 11 by, for example, adhesion, so as to close the through-holes 11*c* of the first elastic member 11. In this case, the grooves c are formed of the side surfaces of the through-holes 11*c* of the first elastic member 11 and a surface (inner surface 12*a*) of the second elastic member 12. With this structure, the tube 10 can carry out the same function as the tube 10 illustrated in FIG. 3.

Although the direction in which the tube 10 is spirally wound is matched to the direction in which the grooves c are spirally wound in the embodiment, the directions of the spirals may be opposite. For example, the tube 10 may be spirally wound around the axis A1 clockwise and the grooves c may be spirally wound around the axial center A2 counterclockwise.

In an actuator with the above structure (third modification not illustrated), when the fluid 5 inside the tube 10 is pressurized, a torsional force is applied to the tube 10 clockwise and acts to cause the actuator 2 to extend in the direction of the axis A1.

Figure 13A:
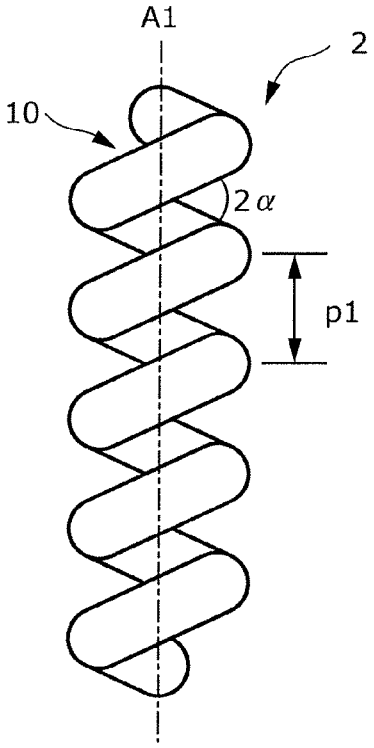
FIG. 13A is a schematic view of an actuator according to a third modification to the first embodiment before a fluid inside a tube is pressurized.
Figure 13B:
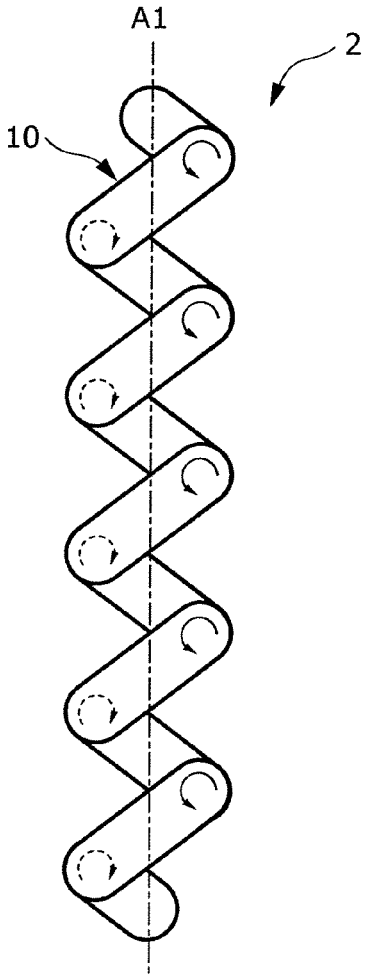
FIG. 13B is a schematic view of the actuator according to the third modification to the first embodiment illustrating extension and contraction of the actuator after the fluid inside the tube is pressurized.

FIG. 13A is a schematic view of the actuator 2 before the fluid 5 inside the tube 10 is pressurized. FIG. 13B is a schematic view of the actuator 2 illustrating extension and contraction of the actuator 2 after the fluid 5 inside the tube 10 is pressurized. In FIG. 13A and FIG. 13B, illustration of the grooves c is omitted.

In this actuator 2, the grooves c are spirally wound counterclockwise. Accordingly, the entire tube 10 is twisted clockwise about the axial center A2 of the tube 10 with the expansion due to the pressurization. The tube 10 is wound around the axis A1 clockwise. Accordingly, the tube 10 is twisted clockwise such that the portions located out of the page toward the reader are rotated in the direction of solid arrows when attention is paid to the right side of the actuator 2 in FIG. 13B. In contrast, the tube 10 is twisted clockwise such that the portions located into the page away from the reader are rotated in the direction of dashed arrows when attention is paid to the left side of the actuator 2. Accordingly, the twist occurring over the entire length of the tube 10 acts such that the pitch angle $\alpha$ of the tube 10 is increased (spiral pitch p1 of the tube 10 is increased) so that the length of the actuator 2 is increased.

That is, in the case where the direction in which the tube 10 is spirally wound is opposite to the direction in which the grooves c are spirally wound, the actuator 2 can extend with the expansion due to the pressurization. The same is true in the case where the tube 10 is wound around the axis A1 counterclockwise.

The actuator may be caused to contract or extend by increasing the pressure of the inside of the tube 10 in a manner in which the inside of the syringe is pressurized by using the plunger and the fluid or an additional fluid is delivered to the inside of the tube 10 of the actuator 2 to increase the amount of the fluid (amount per unit volume of the fluid) contained in the inside of the tube 10 of the actuator 2. The phrase "inside of the syringe is pressurized by using the plunger" may be understood to be "distance between an end of the syringe (at which the fluid is discharged from the syringe) and the plunger is decreased".

The actuator may be caused to contract or extend by decreasing the pressure of the inside of the tube 10 in a manner in which the inside of the syringe is depressurized by using the plunger and the fluid or part of the fluid is collected from the inside of the tube 10 of the actuator 2 to decrease the amount of the fluid (amount per unit volume of the fluid) contained the inside of the tube 10 of the actuator 2. The phrase "inside of the syringe is depressurized by using the plunger" may be understood to be "distance between the end of the syringe and the plunger is increased".

Second Embodiment

An actuator according to a second embodiment differs from the actuator according to the first embodiment in that a first elastic member 11 and a second elastic member 12 are integrally formed as a single piece.

Figure 14:
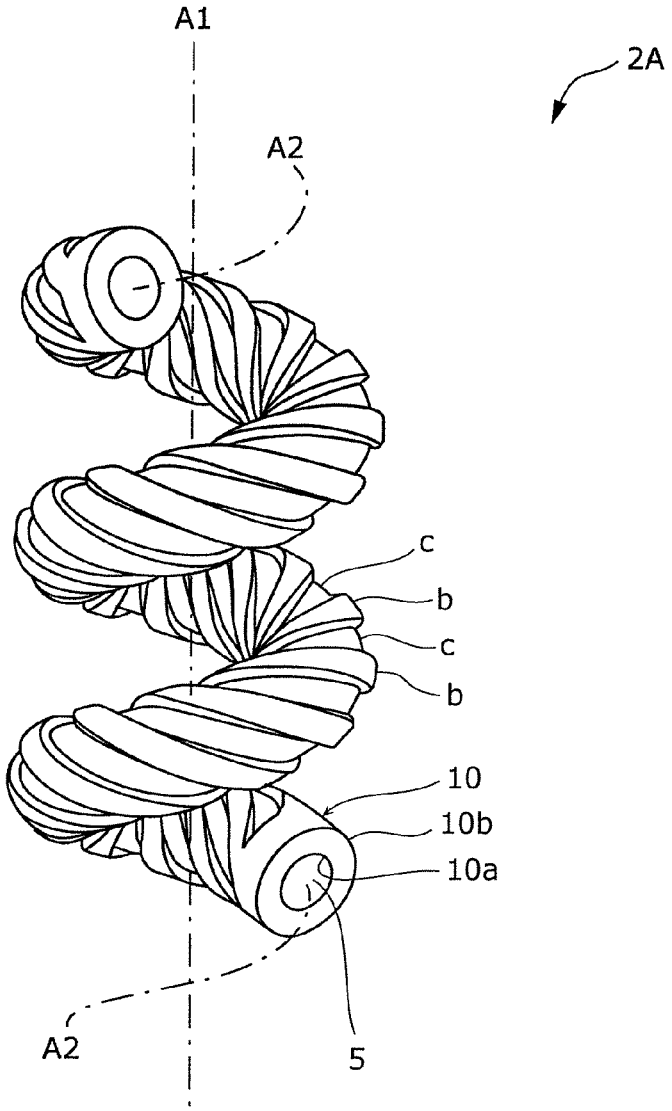
FIG. 14 is a partial view of a tube of an actuator according to a second embodiment.
Figure 15:
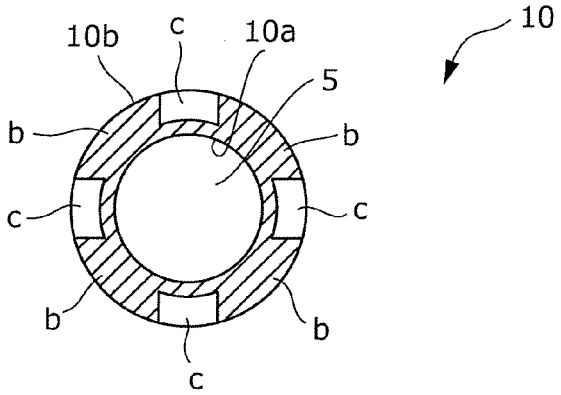
FIG. 15 is a cross-sectional view of the tube of the actuator according to the second embodiment.

FIG. 14 is a partial view of a tube 10 of an actuator 2A. FIG. 15 is a cross-sectional view of the tube 10 of the actuator 2A. In the following drawings, like symbols designate like components to those in the first embodiment, and description of these components is omitted.

The actuator 2A is formed such that the hollow tube 10 that is elastic is spirally wound. The tube 10 is wound around the axis A1 of the actuator 2A. Grooves c are spirally formed on the outer surface 10*b* of the tube 10 such that the central axes of the grooves are the axial center A2 of the tube 10.

The grooves c formed on the tube 10 are a plurality of grooves having constant widths. The depths of the grooves c are larger than or equal to half of the thickness of the tube 10. That is, portions at which the grooves c are formed are flexible compared with portions at which no groove c is formed. The spiral pitches p2 of the grooves c are larger than the length $\pi d$ of the outer circumference of the tube 10.

The tube 10 is hollow. A hollow portion of the tube 10 contains a fluid 5. The tube 10 includes bone portions b located between the grooves c that are adjacent to each other in the circumferential direction of the tube 10. The bone portions b are disposed so as to be spaced apart from each other in the circumferential direction. The bone portions b are four bone portions b1, b2, b3, and b4. Nylon, for example, is used as the material of the tube 10.

In the actuator 2A according to the second embodiment, the tube 10 is integrally formed as a single piece, and the actuator can thus have a simple structure. The actuator 2A achieves the same effects as the actuator 2 according to the first embodiment.

A modification to the actuator 2A according to the second embodiment will now be described.

Figure 16:
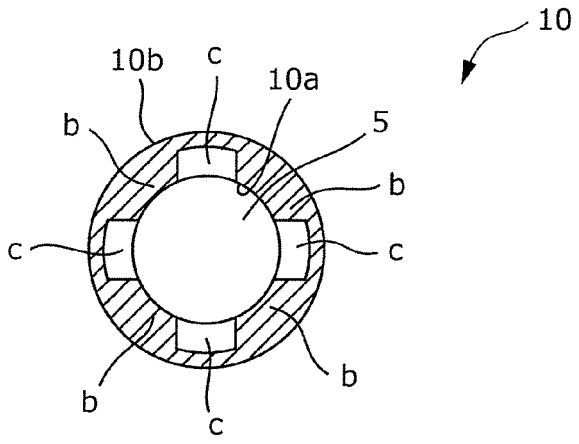
FIG. 16 is a cross-sectional view of a tube of an actuator according to a fourth modification to the second embodiment.
Figure 17:
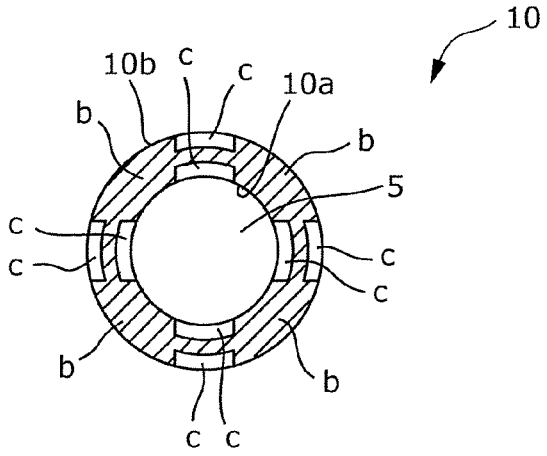
FIG. 17 is a cross-sectional view of a tube of an actuator according to a fifth modification to the second embodiment.
Figure 20:
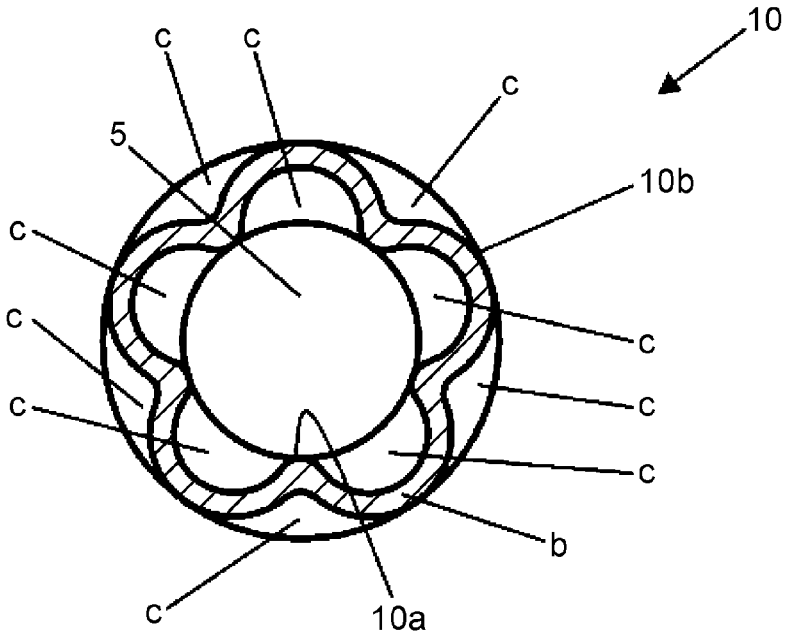
FIG. 20 is a cross-sectional view of a tube of an actuator according to a sixth modification to the second embodiment.

As illustrated in a fourth modification in FIG. 16, in the tube 10 of the actuator 2A, grooves may be formed on the inner surface 10*a* of the tube 10. As illustrated in a fifth modification in FIG. 17, the grooves c may be formed on both the inner surface 10*a* and outer surface 10*b* of the tube 10. As illustrated in a sixth modification in FIG. 20, the grooves c may be formed on both the inner surface 10*a* and outer surface 10*b* of the tube 10 so as to alternate. With these structures, the same functions as the tube 10 illustrated in FIG. 15 can be carried out. In the fifth modification, the grooves on the inner surface 10*a* are formed at positions corresponding to the grooves on the outer surface 10*b*. The grooves, however, are not limited thereto. Forming the grooves at different positions are also acceptable.

Third Embodiment

An actuator according to a third embodiment differs from the actuator according to the first embodiment in having a single groove c.

Figure 18:
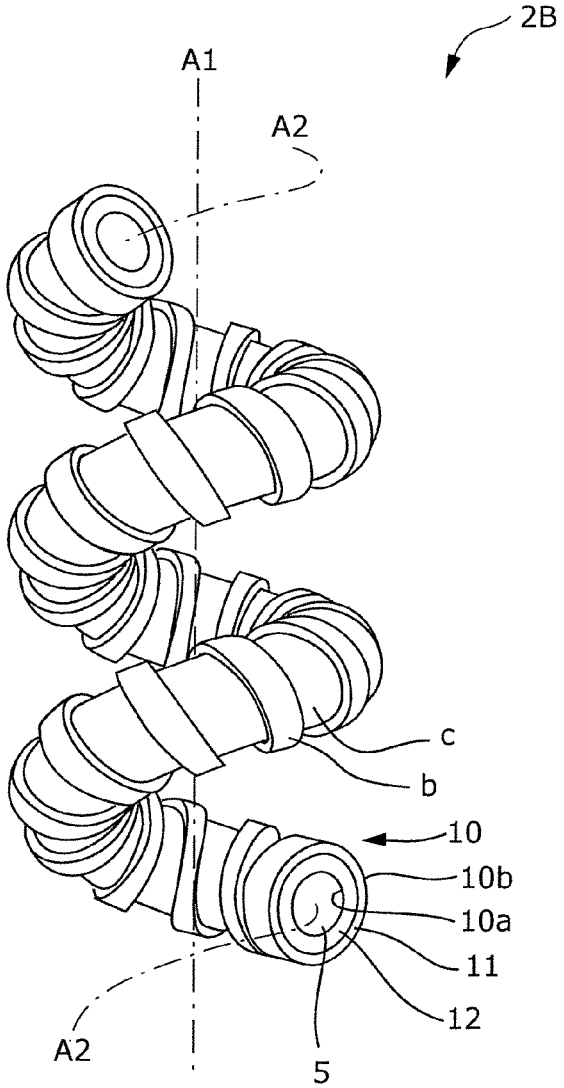
FIG. 18 is a partial view of a tube of an actuator according to a third embodiment.

FIG. 18 is a partial view of a tube 10 of an actuator 2B according to the third embodiment.

The actuator 2B is formed such that the hollow tube 10 that is elastic is spirally wound. The tube 10 is wound around the axis A1 of the actuator 2B. The groove c is spirally formed on the outer surface 10*b* of the tube 10 such that the central axis of the groove is the axial center A2 of the tube 10.

Specifically, the tube 10 includes a cylindrical first elastic member 11 and a cylindrical second elastic member 12 that is more flexible than the first elastic member 11. In the first elastic member 11, a through-hole 11*c* extending from the inner surface 11 a of the first elastic member 11 to the outer surface 11 b is formed. The second elastic member 12 is disposed inside the first elastic member 11 so as to be in contact with the first elastic member 11 and closes the through-hole 11*c*. The first elastic member 11 includes a bone portion b having an arc shape in section. The bone portion b is spirally wound around the axial center A2 so that the groove c is spirally formed.

A method of manufacturing the actuator 2B will be next described.

Figure 19:
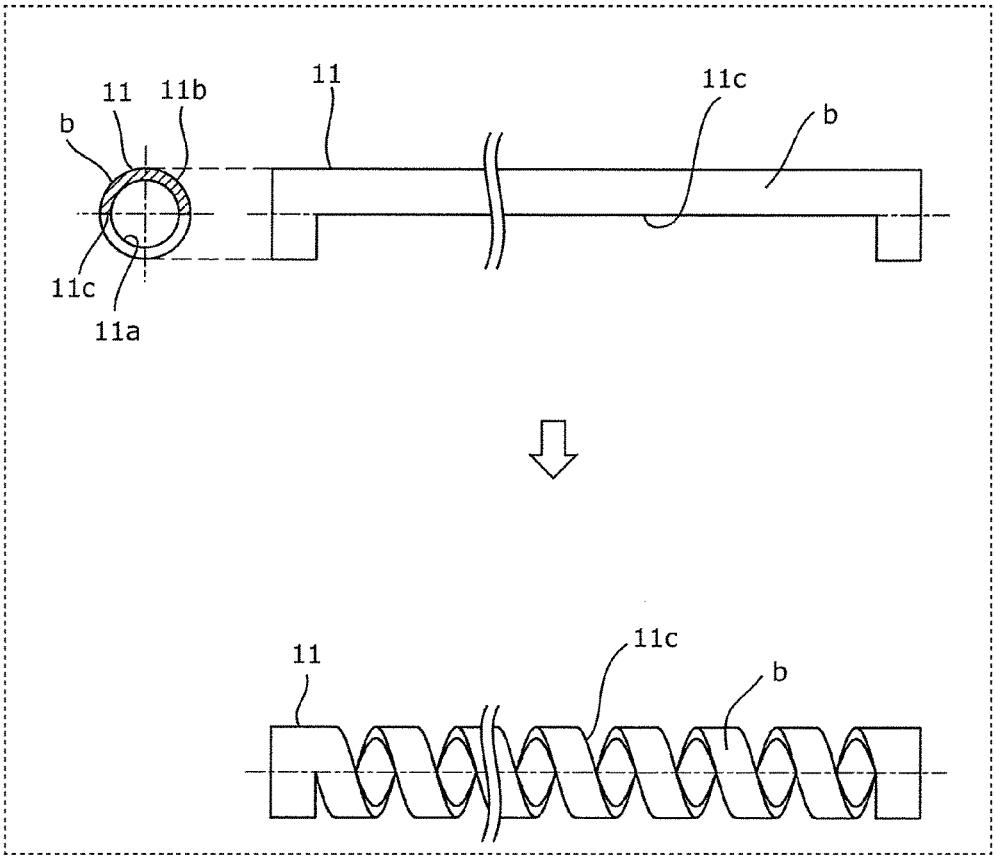
FIG. 19 is a diagram illustrating a method of manufacturing a first elastic member of the actuator according to the third embodiment.

As illustrated in FIG. 19, a cylindrical member that is made of a thermoplastic resin and that includes the bone portion b is first prepared. The cylindrical member is heated to the glass-transition temperature or more. In this state, the cylindrical member is twisted and rotated about the axis. The cylindrical member is then cooled to form the first elastic member 11 including spiral bone portion b. The cylindrical second elastic member 12 is next inserted into the inside of the cylindrical first elastic member 11 to form the tube 10 being straightened. The tube 10 is again heated to the glass-transition temperature or more. In this state, the tube 10 is wound around a core material. The tube 10 is then cooled and the core material is extracted. In this way, the actuator 2B that is spirally wound can be manufactured.

The first elastic member 11 can be manufactured by another manufacturing method. For example, the bone portion b made of a thermoplastic resin is spirally wound around a mandrel, which is the core material, and an anneal process is performed. The mandrel is then removed to form the first elastic member 11. Other than these methods, the first elastic member 11 may be manufactured by a three-dimensional modeling method.

The actuator 2B can achieve effects corresponding to the effects of the actuator 2 according to the first embodiment.

The actuators according to the aspect or the aspects are described above based on the embodiments. The present disclosure, however, is not limited to the embodiments. Modifications to the embodiments that a person skilled in the art thinks of and any embodiment obtained from the combination of the features of the embodiments may be included in the range of the aspect or the aspects without departing from the concept of the present disclosure.

For example, in the above embodiments, water is used as the fluid. The fluid, however, is not limited to water, and any one of known liquids is acceptable. Not only a liquid but also any one of gasses that is a compressible fluid is acceptable.

In the above embodiments, the spiral groove has a constant width. The width is not limited to being constant, and the width of the groove may be varied in the longitudinal direction and/or the width direction of the groove. The spiral groove is not necessarily a continuous groove such as in the case of the embodiments and may be divided at some positions.

In the above embodiments, the syringe pump is used as the pressure source. The pressure source is not limited to the syringe pump, and any known art and combination thereof can be applied thereto, provided that the pressure source can discharge the fluid from and inject the fluid into an interior space.

In the above embodiments, water is discharged from and injected into a coil body whose one end is sealed via the other end. This is not a limitation. Water may be discharged from and injected into coil body via the other end and a port via which water is discharged from and injected into the coil body may be formed at a midway portion of the coil body. An increase in the number of the ports via which water is discharged from and injected into enables the responsiveness of the actuator to be improved.

The actuator according to the aspect of the present disclosure can be used as an artificial muscle actuator that drives a machine that works close to humans and can be applied to the field of assisting equipment that is wearable like clothes. Other than these, the actuator can be used as a linear actuator that is flexible against an external force and a lightweight linear actuator.

What is claimed is:

1. An actuator comprising:

a hollow tube, wherein the tube has a space therein which is located along a longitudinal axis of the tube, wherein the tube is folded so as to have a coil shape, wherein the tube has one or more grooves formed on an outer surface of the tube and/or an inner surface of the tube, wherein the one or more grooves extend so as to be twisted along the longitudinal axis of the tube, wherein the tube includes a cylindrical first elastic member, and a cylindrical second elastic member that is disposed inside or outside the first elastic member and that is more flexible than the first elastic member, and wherein the one or more grooves are each formed of a through-hole extending from an inner surface of the first elastic member to an outer surface of the first elastic member and a surface of the second elastic member that closes the through-hole.

2. The actuator according to claim 1, wherein the first elastic member includes one or more spiral bone portions located between the grooves that are adjacent to each other in a circumferential direction of the first elastic member, and wherein thicknesses of the one or more bone portions are less than widths of the one or more bone portions.

3. The actuator according to claim 1, wherein spiral pitches of the one or more grooves are larger than a length of an outer circumference of the first elastic member.

4. The actuator according to claim 1, wherein the first elastic member is disposed outside the second elastic member, and ridges formed of the inner surface of the first elastic member and side surfaces of the one or more grooves are chamfered.

5. An actuator comprising:

a hollow tube, wherein the tube has a space therein which is located along a longitudinal axis of the tube, wherein the tube is folded so as to have a coil shape, wherein the tube includes a cylindrical first elastic member and a second elastic member that is more flexible than the first elastic member, wherein the first elastic member has a through-hole extending from an inner surface of the first elastic member to an outer surface of the first elastic member, wherein the through-hole extends so as to be twisted along the longitudinal axis of the tube, and wherein the second elastic member is disposed in the through-hole.

6. An actuator apparatus comprising:

an actuator; and a pressure source, wherein the actuator includes a hollow tube that is elastic, wherein the tube has a space therein which is located along a longitudinal axis of the tube, wherein the tube is folded so as to have a coil shape, wherein the tube has one or more grooves formed on an outer surface of the tube and/or an inner surface of the tube, wherein the one or more grooves extend so as to be twisted along the longitudinal axis of the tube, and wherein the pressure source (a1) causes the actuator to contract by increasing a pressure of an inside of the tube and (a2) causes the actuator to extend by decreasing the pressure of the inside of the tube.

7. The actuator apparatus according to claim 6, wherein the pressure source increases a pressure of the actuator by injecting a medium into the inside of the tube in the (a1) and decreases the pressure of the actuator by discharging the medium from the inside of the tube in the (a2).

8. A method of driving an actuator, comprising:

(b1) preparing an actuator, the actuator including a hollow tube that is elastic, the tube having a space therein which is located along a longitudinal axis of the tube, the tube being folded so as to have a coil shape, the tube having one or more grooves formed on an outer surface of the tube and/or an inner surface of the tube, the one or more grooves extending so as to be twisted along the longitudinal axis of the tube; and (b2) causing the actuator to contract by increasing a pressure of a medium inside the tube.

9. The method according to claim 8, further comprising:

(b3) causing the actuator to extend by decreasing the pressure of the medium inside the tube.

* * * * *